US005483120A

United States Patent [19]

Murakami

[11] Patent Number: 5,483,120

[45] Date of Patent: Jan. 9, 1996

[54] ELECTROLUMINESCENT DEVICE HAVING IMPROVED ELECTRODE TERMINALS

[75] Inventor: Hiroki Murakami, Kanagawa, Japan

[73] Assignee: Fuji Xerox Co., Ltd., Tokyo, Japan

[21] Appl. No.: 132,232

[22] Filed: Oct. 6, 1993

Related U.S. Application Data

[63] Continuation of Ser. No. 774,918, Oct. 11, 1991, abandoned.

[30] Foreign Application Priority Data

Dec. 18, 1990 [JP] Japan ..... 2-411344

[51] Int. Cl.[6] ..... H01J 1/54; H01R 9/24; G09G 3/10

[52] U.S. Cl. ..... 313/506; 313/498; 313/505; 313/331; 428/917; 439/890; 439/891; 315/169.3

[58] Field of Search ..... 313/498, 505, 313/506, 331, 49, 51, 318; 428/917; 439/617, 618, 619, 886, 889, 890, 891, 68, 69, 71, 72, 76, 83; 345/36, 45, 76; 315/169.3

[56] References Cited

U.S. PATENT DOCUMENTS 3,594,610 7/1971 Evans et al. ..... 345/76 X
4,455,506 6/1984 Ayyagari et al. ..... 313/506
4,777,402 10/1988 Mitsumori ..... 313/505 X
5,266,865 11/1993 Haizumi et al. ..... 313/51 X

FOREIGN PATENT DOCUMENTS 2033125 5/1980 United Kingdom ..... 340/752

*Primary Examiner*—Sandra L. O'Shea
*Assistant Examiner*—Matthew J. Esserman
*Attorney, Agent, or Firm*—Finnegan, Henderson, Farabow, Garrett & Dunner

[57] ABSTRACT

A transparent electrode, luminescent layer, back electrode are formed on one side of a first insulative substrate. A second insulative substrate is adhered to the first insulative substrate by an insulative adhesive. The back electrode is divided into two sub-electrodes. A pair of electrode pads are formed on the second insulative substrate so as to be opposed to at least respective parts of the sub-electrodes, and connected to those parts of the sub-electrodes by a conductive connector.

8 Claims, 6 Drawing Sheets

ELECTROLUMINESCENT DEVICE HAVING IMPROVED ELECTRODE TERMINALS

This application is a continuation of application Ser. No. 07/774,918, filed Oct. 11, 1991, now abandoned.

BACKGROUND OF THE INVENTION

The present invention relates to an electroluminescent (hereinafter referred to as "EL") device which emits light by application of a voltage across the electrodes between which a luminescent layer is interposed. More specifically, the invention relates to an EL device in which the terminals of a drive voltage supply are easily connected to the electrodes of the EL device, and which has a low production cost.

In EL devices, when a voltage is applied across the electrodes formed on both surfaces of a luminescent layer, electrons are accelerated by an electric field developing in the luminescent layer, and then collide with luminescent centers existing in the luminescent layer to excite those. The luminescent centers emit light when they return to their ground state. The EL device is constructed by sequentially forming a first electrode, a luminescent layer, an insulation layer and a second electrode on an insulative substrate, and terminals of a voltage supply are connected to the two electrodes to supply a voltage.

The insulation layer between the luminescent layer and the second electrode may be omitted if the luminescent layer is of a dispersion type in which luminescent substances are dispersed in a binder.

Such EL devices are used as a display, an optical printer head, and as a light source of an image reading apparatus. In some cases, the substrate on which the electrodes, luminescent layer, etc. are formed is adhered to the other insulative substrate. An example of this type of EL device is shown in FIGS. 7(*a*) and 7(*b*), which is used as a light source of an image reading apparatus.

A transparent electrode 702, luminescent layer 703, insulation layer 704 and non-transparent electrode 705 are formed in sequence on a transparent glass substrate 701 having a thickness of about 50–100 μm.

The transparent glass substrate 701 provided with the EL luminescent layer 703 is adhered to the other insulative substrate 707 provided with light receiving elements 706, by a transparent, insulative adhesive 708 such that the electroluminescent layer 703 and the light receiving elements are opposed to each other. Windows 709 are formed through the luminescent layer 703, insulation layer 704 and non-transparent electrode 705 at their portions opposite to the light receiving elements 706.

In this type of image reading apparatus, while an original document 710 placed on the transparent glass substrate 701 is being scanned, the luminescent layer emits light being driven by a voltage applied across the electrodes 702 and 705, and the emitted light is reflected by the original document surface, passed through the windows 709, and detected by the light receiving elements 706. The light receiving elements 706 convert the detected light to an electrical signal, which serves as image information.

Since the luminescent layer can be located near the original document surface, the above image reading apparatus using the EL device has such advantages that the image reading can be performed satisfactorily even if the luminance of the light source is lower than that of the image reading apparatus using LEDs, etc., and that the apparatus can be made compact.

However, in the conventional EL device, terminals for connecting the voltage supply terminals to the electrodes are formed on the insulative substrate on which the luminescent layer, electrodes, etc. are formed. Therefore, the device is disadvantageous in that it needs much time and labor in fabrication, and that the production cost is high while the manufacturing yield is low.

Particularly in the case of the EL device for use in the image reading apparatus, since transparent glass having a thickness of about 50–100 μm is employed as the insulative substrate on which the luminescent layer and other layers are formed, the insulative layer is so fragile as to cause difficulties in processing it.

SUMMARY OF THE INVENTION

The present invention has been made in view of the above circumstances and, therefore, an object of the invention is to provide an EL device which facilitates connection of its electrodes and the terminals of a drive voltage supply, to thereby reduce its production cost and increase its production yield.

According to a first aspect of the invention, an electroluminescent device in which a first electrode, an electroluminescent layer and a second electrode are formed on one side of an insulative substrate in this order, comprises:

the second electrode being divided into two sub-electrodes;

the first electrode being continuous within an area opposite to the second electrode;

means for connecting the two sub-electrodes to two terminals of a voltage supply, respectively.

According to a second aspect of the invention, an electroluminescent device, in which a first electrode, an electroluminescent layer and a second electrode are formed on one side of a first insulative substrate in this order, and a second insulative substrate is provided on the one side of the first insulative substrate with an insulation layer interposed therebetween, comprises:

a pair of electrode pads each formed on the second insulative substrate so as to be opposed to at least part of the first or second electrode; and a pair of conductive connectors for electrically connecting the first and second electrodes to the pair of electrode pads, respectively.

BRIEF DESCRIPTION OF THE DRAWINGS

FIG. 1(*b*) is a schematic sectional view taken along line 1(*b*)—1(*b*) in FIG. 1(*a*);

FIG. 3(*b*) is a schematic plan view showing an alternative back electrode arrangement for the second embodiment of FIG. 3(*a*).

FIGS. 4(*b*)–(*d*) are schematic sectional views taken along lines 4(*b*)—4(*b*), 4(*c*)—4(*c*), and 4(*d*)—4(*d*);

FIG. 6(*b*) is a schematic sectional view taken along line 6(*b*)—6(*b*) in FIG. 6(*a*);

FIG. 7(*b*) is a schematic sectional view taken along line 7(*b*)–7(*b*) in FIG. 7(*a*).

DESCRIPTION OF THE PREFERRED EMBODIMENTS

Figure 1A:
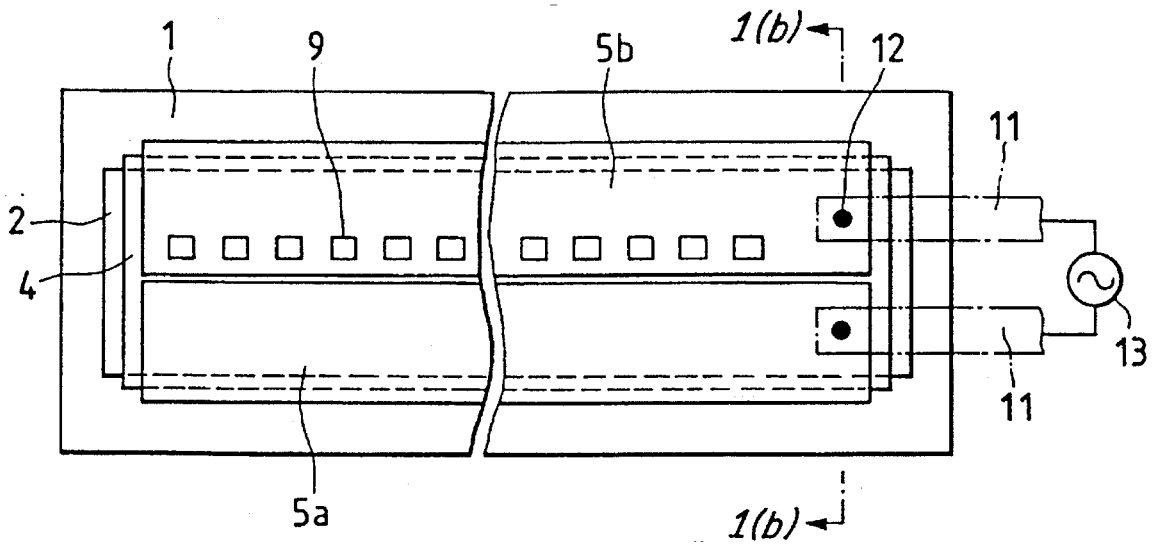
FIG. 1(*a*) is a schematic plan view showing the arrangement of a part of an EL device according to a first embodiment of the present invention.

Embodiments of the present invention will be described below with reference to the accompanying drawings.

Formed sequentially on the transparent glass substrate 1 (a first insulative substrate) are: an ITO transparent electrode 2 as a first electrode, a luminescent layer 3 made up by dispersing, in a binder, ZnS powder to which luminescent center substances are added, an insulation layer 4 made of $BaTiO_3$, and an aluminum back electrode 5 as a second electrode. A plurality of windows 9 are formed through the luminescent layer 3, insulation layer 4 and back electrode 5. The back electrode 5 is divided into two electrodes 5*a*, 5*b*.

The surface of the transparent glass substrate 1 on which the luminescent layer 3, etc. are formed is adhered, by a transparent, insulative adhesive 8, to the other insulative substrate 7 on which two electrode pads 11, 11 are provided so as to be partially opposed to the respective divided back electrodes 5*a*, 5*b*. The back electrodes 5*a*, 5*b* and the two electrode pads 11, 11 are connected by conductive connectors 12, 12 inserted therebetween.

Light receiving elements (not shown) are provided on the insulative substrate 7 in the portions corresponding to the windows 9, to detect light which has been emitted from the luminescent layer 3, reflected by an original document 10 placed on the transparent glass substrate 1, and passed through the windows 9. An AC voltage supply 13 is connected to the two electrode pads 11, 11 provided on the insulative substrate 7.

Figure 2:
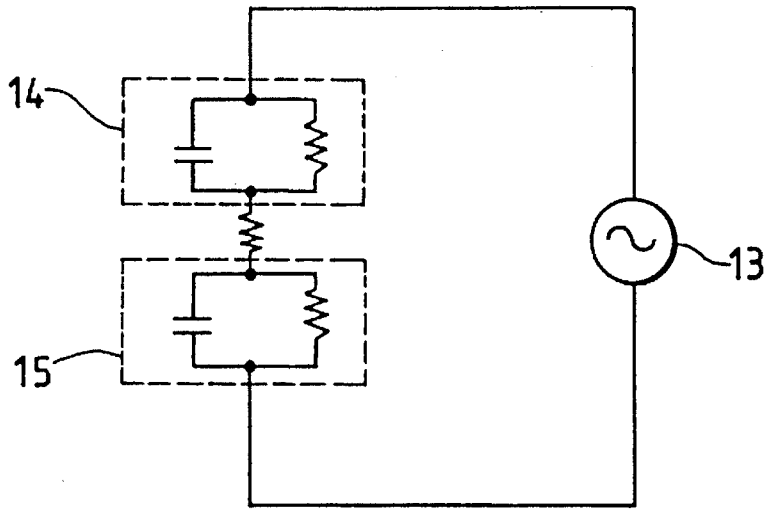
FIG. 2 is a circuit diagram showing an equivalent circuit of the EL device of FIGS. 1(*a*) and 1(*b*)

A pulsed voltage from the AC power supply 13 is applied across the two back electrodes 5*a*, 5*b* via the electrode pads 11, 11 and the conductive connectors 12, 12. Since the transparent electrode 2 is continuous (i.e., a single part) which is opposed to the electrodes 5*a*, 5*b* with the luminescent layer 3 interposed therebetween, the arrangement is expressed by an equivalent circuit shown in FIG. 2 in which two EL devices 14, 15 are connected in series. Therefore, approximately ½ of the voltage applied across the two back electrodes 5*a*, 5*b* is applied across each of the two luminescent regions formed between the two back electrodes 5*a*, 5*b* and the transparent electrode 2, and both of the two luminescent regions emit light. Scanned with this light, the original document 10 can be read by the light receiving elements.

Figure 3A:
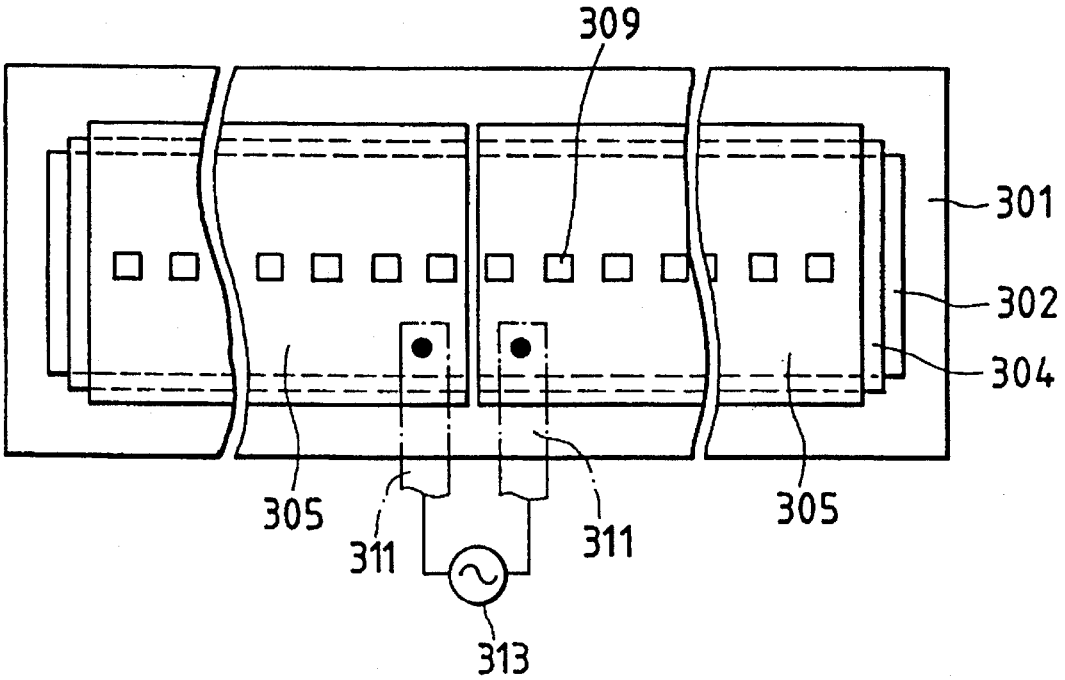
FIG. 3(*a*) is a schematic plan view showing the arrangement of a part of an EL device according to a second embodiment of the invention.
Figure 3B:
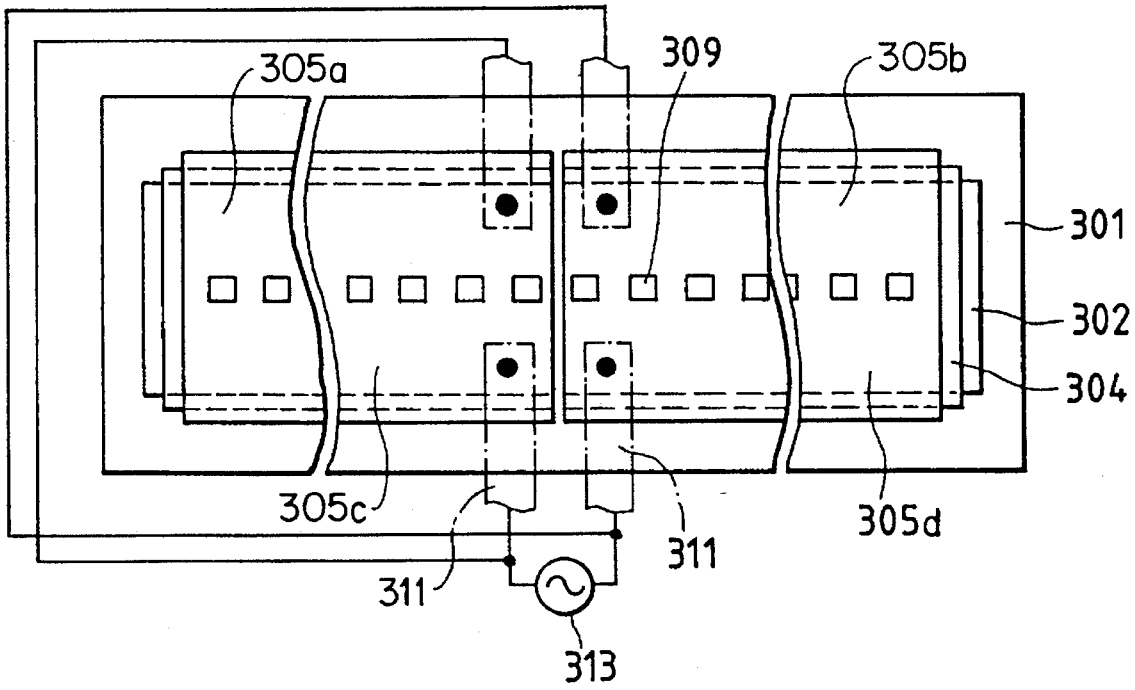
Figure 4A:
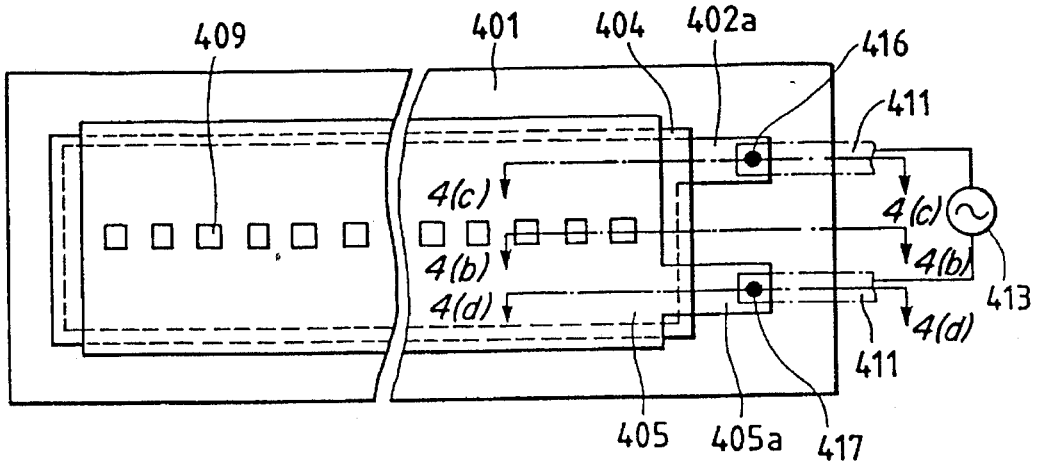
FIG. 4(*a*) is a schematic plan view showing the arrangement of a part of an EL device according to a third embodiment of the invention.
Figure 4B:
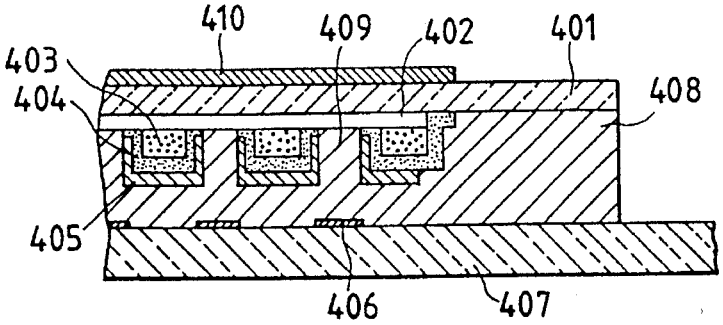
Figure 4C:
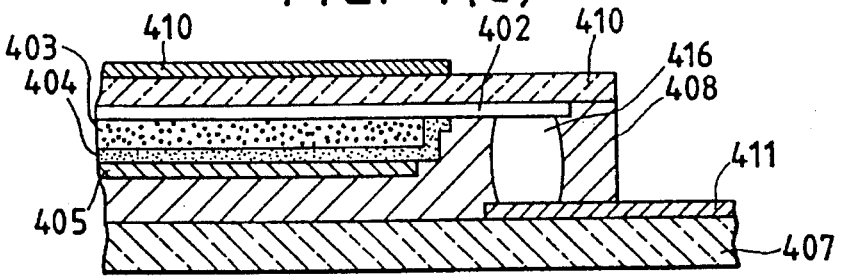
Figure 4D:
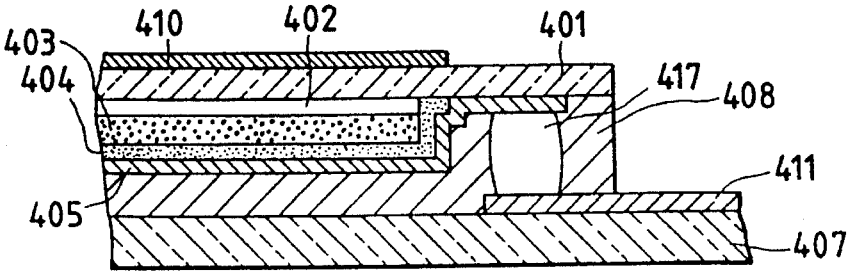

FIG. 3 is a schematic plan view showing an EL device according to a second embodiment of the invention.

Figure 1B:
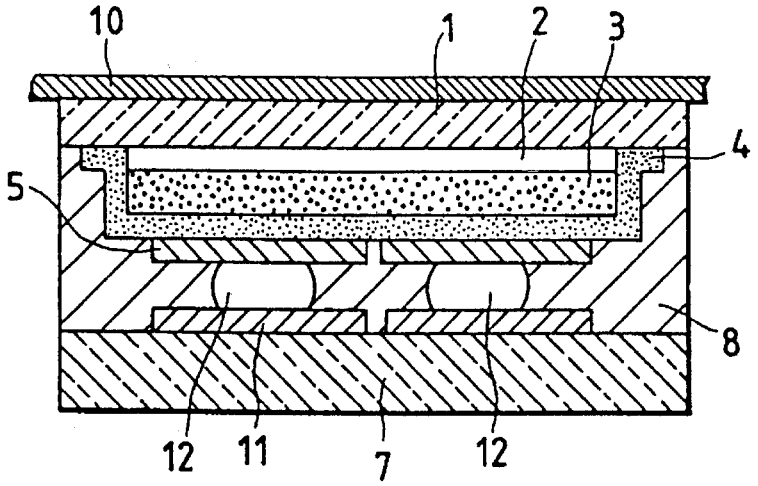

As in case of the first embodiment of FIGS. 1(*a*) and 1(*b*), a transparent electrode 302, a luminescent layer (not shown), an insulation layer 304 and a back electrode 305 are formed on a transparent glass substrate 301. As a specific feature of this embodiment, the back electrode 305 is cut in the direction traversing the arrangement direction of windows 309 arranged in line, and the resultant divided parts of the electrode 305 are connected to electrode pads 311, 311, respectively.

Also in the case of the EL device according to the second embodiment, the entire luminescent layer emits light, and an original document can be read as in the second embodiment of FIGS. 1(*a*) and 1(*b*).

Although in the embodiments shown in FIGS. 1(*a*) and 1(*b*) and FIG. 3 the back electrode is divided into two parts, it may be divided into parts of an even number equal to or larger than 4 with each two parts being associated to form a pair, and each pair may be connected to the two terminals of the voltage supply. An example of such a modification is illustrated in FIG. 3(*b*), wherein the back electrode is divided into four separate electrodes 305*a*–305*d*. Additional electrode pads 311 are provided, such that back electrodes 305*a* and 305*c* are one pair commonly connected to one terminal of voltage supply 313 and back electrodes 305*b* and 305*d* are a second pair commonly connected to the other voltage supply terminal. In this case, it suffices that the transparent electrode is continuous within the area of the paired back electrode.

FIGS. 4(*a*)–4(*d*) show the construction of an EL device according to a third embodiment of the invention, which is applied to an image reading apparatus.

Formed sequentially on the transparent glass substrate 401 (a first insulative substrate) are: an ITO transparent electrode 402 as a first electrode, a luminescent layer 403 made up by dispersing, in a binder, ZnS powder to which luminescent center substances are added, an insulation layer 404 made of $BaTiO_3$, and an aluminum back electrode 405 as a second electrode. The transparent electrode 402 and the back electrode 405 are respectively provided with extensions 402*a* and 405*a* which are separated by the insulation layer 404. A plurality of windows 409 are formed through the luminescent layer 403, insulation layer 404 and back electrode 405.

The surface of the transparent glass substrate 401 on which the luminescent layer 403 and other layers are formed is adhered to the other insulative substrate 407 by a transparent, insulative adhesive 408. The extension 402*a* of the transparent electrode 402 and that extension 405*a* of the back electrode 405 are opposed to two electrode pads 411, 411 provided on the insulative substrate 407, and connected thereto by conductive connectors 416 and 417, respectively. An AC power supply 413 is connected to the electrode pads 411, 411 to allow application of a pulsed voltage.

Light receiving elements 406 are provide on the insulative substrate 407 in the portions corresponding to the windows 409, to detect light which is emitted from the luminescent layer 403, reflected by an original document 410 placed on the transparent glass substrate 401, and passed through the windows 409.

A pulsed voltage applied to the EL device at the electrode pads 411, 411 are introduced to the transparent electrode 402 and the back electrode 405 to have an electric field develop therebetween, and the luminescent layer 403 emits light accordingly.

Figure 5:
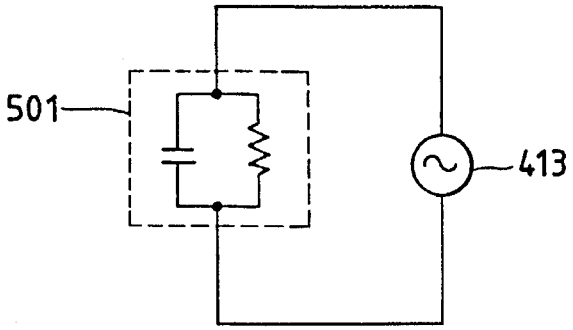
FIG. 5 is a circuit diagram showing an equivalent circuit of the EL device of FIGS. 4(*aa*)—4(*d*)

The EL device of the third embodiment is expressed by an equivalent circuit shown in FIG. 5. Since the voltage from the voltage supply 413 is directly applied to the single EL device 501, the voltage from the voltage source 413 can be reduced to ½ as compared with the first and second embodiments of FIGS. 1(*a*) and (*b*) and FIG. 2.

Figure 6A:
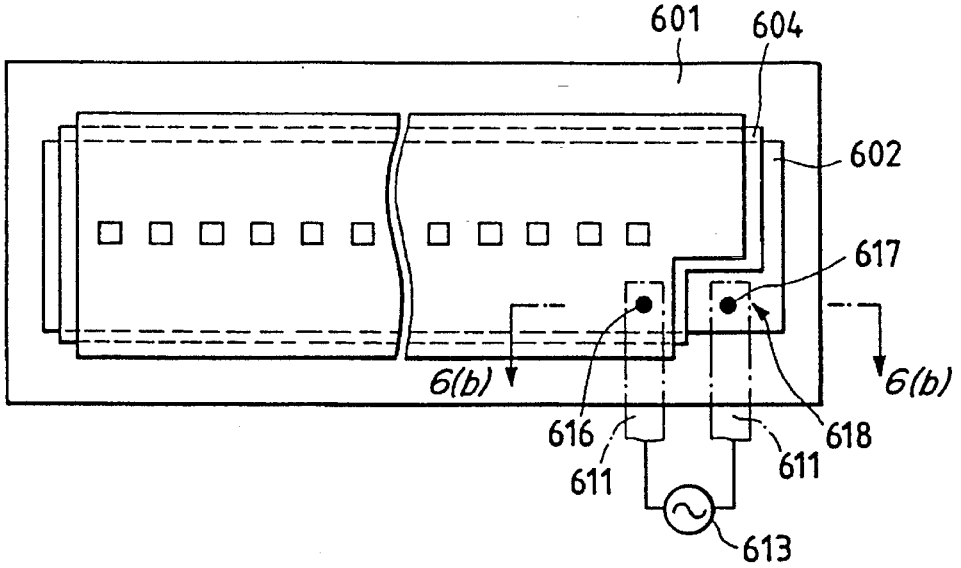
FIG. 6(*a*) is a schematic plan view showing the arrangement of a part of an EL device accord to a fourth embodiment of the invention.
Figure 6B:
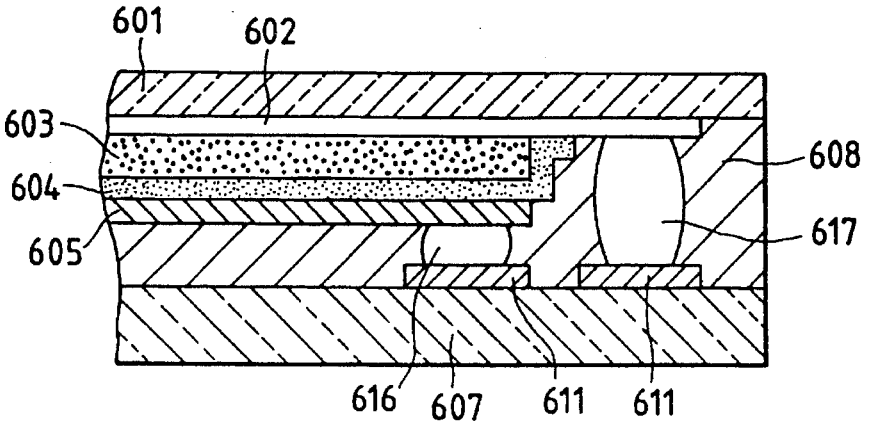
Figure 7A:
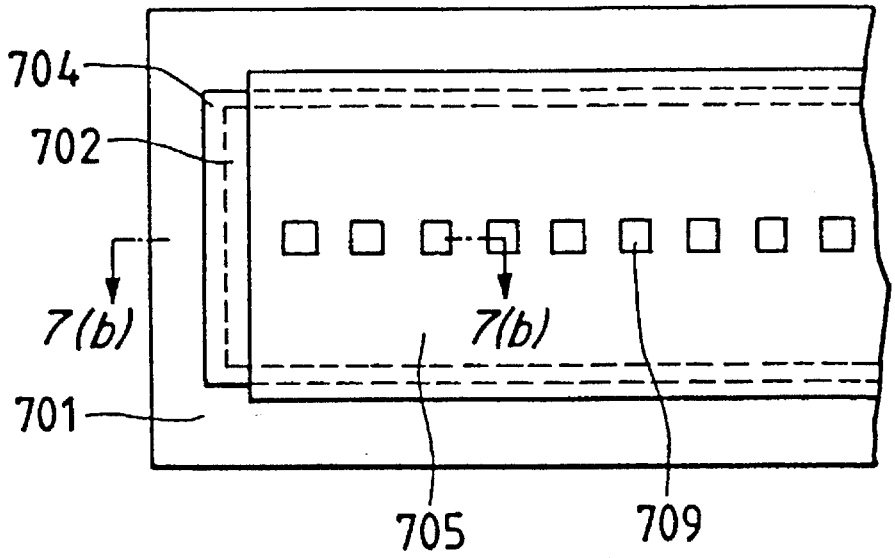
FIG. 7(a) PRIOR ART
FIG. 7(*a*) is a schematic plan view showing the arrangement of a part of a conventional EL device.
Figure 7B:
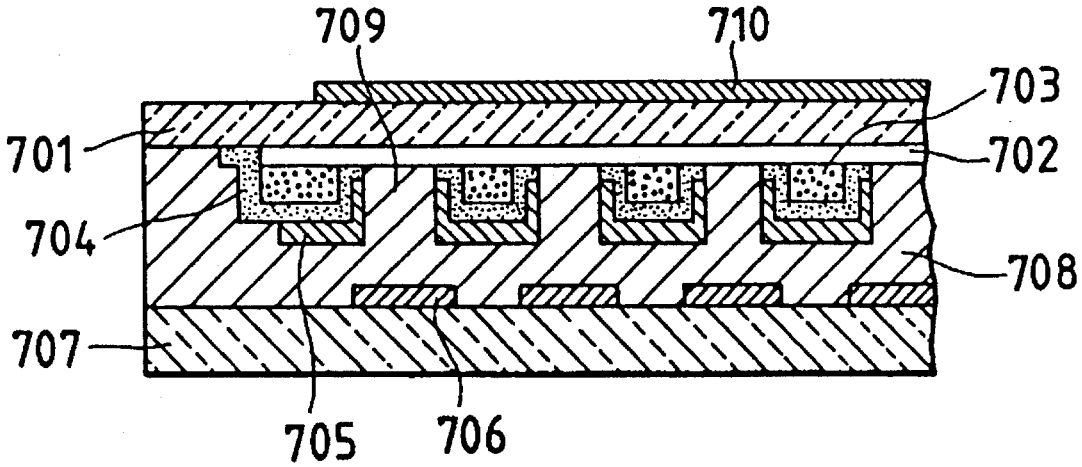
FIG. 7(b) PRIOR ART

FIGS. 6(*a*) and 6(*b*) show an EL device according to a fourth embodiment of the invention stated, in which, as in the third embodiment of FIG. 4, a transparent electrode 602, a luminescent layer 603, an insulation layer 604 and a back electrode 605 are formed in sequence on a transparent glass substrate 601. This embodiment has a specific feature that the luminescent layer 603, the insulation layer 604 and the back electrode 605 are not formed on a part 618 of the transparent electrode 602, and this part 618 and a part of the back electrode 605 are opposed to a pair of electrode pads 611, 611, respectively.

The transparent electrode 602 and back electrode 605 are connected to the electrode pads 611, 611 by respective conductive connectors 617 and 616 which are different in height, and an AC power supply 613 is connected to the electrode pads 611, 611.

The EL device of FIGS. 6(*a*) and 6(*b*) emits light in the same manner as in the third embodiment of FIGS. 4(*a*)–4(*d*) to allow image reading by the light receiving elements. Further, the shape of respective layers formed on the transparent glass substrate 601 can be simplified, the substrate can be made small.

As described above, according to the invention, the back electrode is divided into an even number of parts, and each two parts are paired and connected to the two terminals of the voltage supply. Therefore, the transparent electrode formed between the luminescent layer and the substrate need not be directly connected to the voltage supply, which facilitates the connection to the voltage supply terminals and reduces the cost of fabricating the EL device.

Even where a transparent electrode having high resistance (e.g., ITO) is employed as the transparent electrode, since a voltage is not directly applied to it and the luminescent layer operates as if it were divided into, e.g., two parts to shorten the effective length of the electrode, a luminance fluctuation due to the voltage drop is reduced even if the EL device covers a large area.

Where the insulative substrate on which the luminescent layer is formed is adhered to the other insulative substrate and driven via the electrode pads provided on the other insulative substrate, a simplified structure is realized which does not require providing connection terminals on the insulative substrate on which the luminescent layer is formed. As a result, the electrodes can easily be connected to the voltage supply terminals, and the EL device can easily be manufactured with a higher yield.

In particular, the EL device can easily be manufactured even where the glass of approximately 50–100 μm in thickness is used for the substrate on which the luminescent layer is to be formed.

Since the electrodes formed on the first insulative substrate and the electrode pads, which are opposed to each other at an extremely small interval, are connected simply by the conductive connectors, the device can easily be manufactured and reliability of the connection can be enhanced.

What is claimed is:

1. An electroluminescent device comprising:

a first insulative substrate;

a first electrode formed over the first insulative substrate;

an electroluminescent layer formed over the first electrode;

a pair of second electrodes formed over the electroluminescent layer in opposed relation to the first electrode; and terminals supported independently of the pair of second electrodes for connecting the pair of second electrodes to respective terminals of a voltage supply.

2. The electroluminescent device according to claim 1, which further includes a second insulative substrate formed over the second electrodes for supporting the terminals.

3. The electroluminescent device according to claim 1, which further includes an insulative layer separating the second insulative substrate from the second electrodes, and each terminal includes a conductive pad supported on a surface of the second insulative substrate in offset relation to the second electrodes and a conductive element electrically connecting the pad to a different one of the second electrodes.

4. The electroluminescent device according to claim 3, wherein the conductive element of each terminal extends through the insulative layer.

5. An electroluminescent device comprising:

a first transparent insulative substrate;

a first transparent electrode formed over the first insulative substrate;

an electroluminescent layer formed over the first electrode; a second electrode formed over the electroluminescent layer in opposed relation to the first electrode;

a transparent insulative layer formed over said second electrode;

a second insulative substrate formed over the insulative layer;

a plurality of registered light transmitting windows formed in the electroluminescent layer and the second electrode;

a plurality of light detecting element situated on a surface of the second insulative substrate in respective registry with the light transmitting windows;

a first terminal for connecting the first electrode to one side of a voltage supply, said first terminal including a portion of the first electrode extending laterally beyond the electroluminescent layer and the second electrode and situated on a surface of the first insulative substrate, a first conductive pad situated on a surface of the second insulative substrate in opposed relation with the first electrode portion, and a first conductive element electrically interconnecting the first electrode portion and the first conductive pad; and a second terminal for connecting the second electrode to another side of the voltage supply, said second terminal including a portion of the second electrode, a second conductive pad Situated on the surface of the second insulative substrate in opposed relation with the second electrode portion and in laterally-spaced relation with the first conductive pad, and a second conductive element electrically interconnecting the second electrode portion and the second conductive pad.

6. The electroluminescent device according to claim 5, wherein the second electrode portion is an extension of the second electrode extending laterally beyond the electroluminescent layer into a position situated on the surface of the first insulative substrate.

7. The electroluminescent device according to claim 6, wherein the first and second conductive elements extend through the insulative layer.

8. The electroluminescent device according to claim 5 wherein the electroluminescent layer and the second electrode are notched to accommodate extension of the first conductive element between the first electrode portion and the first conductive pad.

* * * * *